US006618699B1

(12) United States Patent
Lee et al.

(10) Patent No.: US 6,618,699 B1
(45) Date of Patent: Sep. 9, 2003

(54) FORMANT TRACKING BASED ON PHONEME INFORMATION

(75) Inventors: Minkyu Lee, Yardley, PA (US); Bernd Moebius, Chatham, NJ (US); Joseph Philip Olive, Watchung, NJ (US); Jan Pieter Van Santen, Brooklyn, NY (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/386,037

(22) Filed: Aug. 30, 1999

(51) Int. Cl.[7] ..... G10L 19/02

(52) U.S. Cl. ..... 704/209; 704/220; 704/221

(58) Field of Search ..... 704/276, 270.1, 704/269, 267, 266, 260, 258, 254, 251, 244, 243, 235, 220, 209

(56) References Cited

U.S. PATENT DOCUMENTS

| | | | | | |
|---|---|---|---|---|---|
| 4,424,415 | A | * | 1/1984 | Lin | 704/209 |
| 5,204,905 | A | * | 4/1993 | Mitome | 704/260 |
| 5,751,907 | A | | 5/1998 | Moebius et al. | 704/267 |
| 2001/0021904 | A1 | * | 9/2001 | Plumpe | 704/209 |

OTHER PUBLICATIONS

Hunt, "A Robust Formant–Based Speech Spectrum Comparison Measure," Proceedings of ICASSP, pp. 1117–1120, 1985, vol. 3.*

Laprei et al., "A new paradigm for reliable automatic formant tracking," Proceedings of ICASSP, pp. 19–22, Apr. 1994, vol. 2.*

Rabiner, "Fundamentals of Speech Recognition," Prentice Hall, 1993, pp. 95–97.*

Schmid, "Explicit N–Best Formant Features for Seqment–Based Speech Recognition," a dissertation submitted to the Oregon Graduate Institute of Science & Technology, Oct. 1996.*

Sun, "Robust Estimation of Spectral Center–of–Gravity Trajectories Using Mixture Spline Models," Proceedings of the 4th European Conference on Speech Communication and Technology Madrid, Spain, pp. 749–752, 1995.*

Lee, Minkyu et al., "Formant Tracking Using Segmental Phonemic Information", Presentation given at Eurospeech '99, Budapest, Hungary, Sep. 9, 1999.

* cited by examiner

*Primary Examiner*—Marsha D. Banks-Harold
*Assistant Examiner*—V Paul Harper

(57) ABSTRACT

A method and system for selecting formant trajectories based on input speech and corresponding text data. The input speech is analyzed to obtain formant candidates for the respective time frame. The text data corresponding to the input speech is converted into a sequence of phonemes which are then time aligned such that each phoneme is temporally labeled with a corresponding segment of the input speech. Nominal formant frequencies are assigned to a center timing point of each phoneme and target formant trajectories are generated for each time frame by interpolating the nominal formant frequencies between adjacent phonemes. For each time frame, at least one formant candidate that is closest to the corresponding target formant trajectories is selected according to a minimum cost factor. The selected formant candidates are output for storage or further processing in subsequent speech applications.

19 Claims, 10 Drawing Sheets

*FIG. 4*

40

| ** * s"E D& s"E * "OtiN g"I | | |
|---|---|---|
| | * | 0.490000 |
| s"E | | |
| | s | 0.645000 |
| | E | 0.863000 |
| D& | | |
| | dcl | 0.896000 |
| | d | 0.901000 |
| | & | 0.995000 |
| s"E | | |
| | s | 1.159000 |
| | E | 1.408000 |
| | * | 1.490000 |
| "OtiN | | |
| | O | 1.647000 |
| . | . | . |
| . | . | . |
| . | . | . |

42 44 46

*FIG. 5*

| 50 | 52 | 54 | 56 | 58 | | | | | |
|---|---|---|---|---|---|---|---|---|---|
| Symbol | CM | $F_1$ | $F_2$ | $F_3$ | Symbol | CM | $F_1$ | $F_2$ | $F_3$ |
| | 0 | 498 | 1527 | 2522 | S | 0 | 564 | 1753 | 2461 |
| T | 0 | 824 | 1699 | 2694 | f | 0 | 768 | 1598 | 2638 |
| h | 0 | 713 | 1862 | 2639 | k | 0 | 476 | 1958 | 2780 |
| kcl | 0 | 500 | 1660 | 2506 | p | 0 | 476 | 1632 | 2583 |
| pcl | 0 | 500 | 1563 | 2734 | s | 0 | 665 | 1658 | 3420 |
| t | 0 | 555 | 1764 | 2651 | tcl | 0 | 530 | 1719 | 2816 |
| D | 0.3 | 218 | 1484 | 2518 | Z | 0.3 | 234 | 1791 | 2555 |
| b | 0.3 | 329 | 1554 | 2530 | bcl | 0.3 | 202 | 1314 | 2326 |
| d | 0.3 | 364 | 1776 | 2705 | dcl | 0.3 | 220 | 1628 | 2587 |
| g | 0.3 | 313 | 1894 | 2699 | gcl | 0.3 | 225 | 2094 | 2836 |
| v | 0.3 | 192 | 1516 | 2510 | z | 0.3 | 278 | 1694 | 3569 |
| N | 0.6 | 236 | 1978 | 2660 | m | 0.6 | 215 | 1338 | 2380 |
| n | 0.6 | 227 | 1636 | 2534 | & | 1 | 509 | 1564 | 2536 |
| > | 1 | 633 | 1070 | 2501 | A | 1 | 408 | 2063 | 2583 |
| E | 1 | 279 | 2324 | 2678 | I | 1 | 596 | 1646 | 2515 |
| O | 1 | 423 | 1054 | 2390 | R | 1 | 413 | 1317 | 1634 |
| U | 1 | 301 | 1146 | 2381 | W | 1 | 694 | 1246 | 2538 |
| Y | 1 | 418 | 1254 | 2371 | ^ | 1 | 602 | 1336 | 2451 |
| a | 1 | 674 | 1703 | 2495 | e | 1 | 579 | 1703 | 2538 |
| i | 1 | 381 | 1868 | 2610 | l | 1 | 339 | 894 | 2634 |
| o | 1 | 679 | 1177 | 2483 | r | 1 | 431 | 1213 | 1720 |
| u | 1 | 387 | 1255 | 2433 | w | 1 | 265 | 563 | 2395 |
| y | 1 | 255 | 2258 | 3123 | | | | | |
| | | | | | 50 | 52 | 54 | 56 | 58 |

*FIG. 6*

| time | CM | $F_1$ | $F_2$ | $F_3$ |
|---|---|---|---|---|
| 1.215000 | 0.449799 | 288.000000 | 2263.000000 | 2646.000000 |
| 1.220000 | 0.489960 | 289.000000 | 2262.000000 | 2651.000000 |
| 1.225000 | 0.489830 | 290.000000 | 2261.000000 | 2650.000000 |
| 1.230000 | 0.489720 | 291.000000 | 2258.000000 | 2648.000000 |
| . | . | . | . | . |
| . | . | . | . | . |
| . | . | . | . | . |
| 60 | 62 | 64 | 66 | 68 |

FORMANT TRACKING BASED ON PHONEME INFORMATION

FIELD OF THE INVENTION

The invention relates generally to the field of speech signal processing, and more particularly, concerns formant tracking based on phoneme information in speech analysis.

BACKGROUND OF THE INVENTION

Various speech analysis methods are available in the field of speech signal processing. A particular method in the art is to analyze the spectrograms of particular segments of input speech. The spectrogram of a speech signal is a two-dimensional representation (time vs. frequency), where color or darkness of each point is used to indicate the amplitude of the corresponding frequency component. At a given time point, a cross section of the spectrogram along the frequency axis (spectrum) generally has a profile that is characteristic of the sound in question. In particular, for voiced sounds, such as vowels and vowel-like sounds, each has characteristic frequency values for several spectral peaks in the spectrum. For example, the vowel in the word "beak" is signified by spectral peaks at around 200 Hz and 2300 Hz. The spectral peaks are called the formants of the vowel and the corresponding frequency values are called the formant frequencies of the vowel. A "phoneme" corresponds to the smallest unit of speech sounds that serve to distinguish one utterance from another. For instance, in the English language, the phoneme lit corresponds to the sound for the "ea" in "beat." It is widely accepted that the first two or three formant frequencies characterize the corresponding phoneme of the speech segment. A "formant trajectory" is the variation or path of particular formant frequencies as a function of time. When the formant frequencies are plotted as a function of time, their formant trajectories usually change smoothly inside phonemes corresponding to a vowel sound or between phonemes corresponding to such vowel sounds. This data is useful for applications such as text-to-speech generation ("TTS") where formant trajectories are used to determine the best speech fragments to assemble together to produce speech from text input.

FIG. 1 is a diagram illustrating a conventional formant tracking method in which input speech 102 is first processed to generate formant trajectories for subsequent use in applications such as TTS. First, a spectral analysis is performed on input speech 102 (Step 104) using techniques, such as linear predictive coding (LPC), to extract formant candidates 106 by solving the roots of a linear prediction polynomial. A candidate selection process 108 is then used to choose which of the possible formant candidates is the best to save as the final formant trajectories 110. Candidate selection 108 is based on various criteria, such as formant frequency continuity.

Regardless of the particular criteria, conventional selection processes operate without reference to text data associated with the input speech. Only after candidate selection is complete are the final formant trajectories 110 correlated with input text 112 processed (formant data processing step 114) to generate, e.g., an acoustic database that contains the processed results associating the final formant data with text phoneme information for later use in another application, such as TTS or voice recognition.

Conventional formant tracking techniques are prone to tracking errors and are not sufficiently reliable for unsupervised and automatic usage. Thus, human supervision is needed to monitor the tracking performance of the system by viewing the formant tracks in a larger time context with the aid of a spectrogram. Nonetheless, when only limited information is provided, even human-supervised systems can be as unreliable as conventional automatic formant tracking.

Accordingly, it would be advantageous to provide an improved formant tracking method that significantly reduces tracking errors and can operate reliably without the need for human intervention.

SUMMARY OF THE INVENTION

The invention provides an improved formant tracking method and system for selecting formant trajectories by making use of information derived from the text data that corresponds to the processed speech before final formant trajectories are selected. According to the invention, the input speech is analyzed in a plurality of time frames to obtain formant candidates for each time frame. The text data corresponding to the input speech is converted into a sequence of phonemes. The input speech is segmented by putting in temporal boundaries. The sequence of phonemes is aligned with a corresponding segment of the input speech. Predefined nominal formant frequencies are then assigned to a center point of each phoneme and this data is interpolated to provide target formant trajectories for each time frame. For each time frame, the formant candidates are compared with the target formant trajectories and candidates are selected according to one or more cost factors. The selected formant candidates are then output for storage or further processing in subsequent speech applications.

BRIEF DESCRIPTION OF THE DRAWINGS

Additional features and advantages of the invention will become readily apparent from the following detailed description of a presently preferred, but nonetheless illustrative embodiment when read in conjunction with the accompanying drawings, in which like reference designations represent like features throughout the enumerated Figures, and where:

FIG. 4 is an exemplary table that lists the identity and timing information for a sequence of phonemes;

FIG. 5 is an exemplary lookup table listing nominal formant frequencies and the confidence measure for specific phonemes;

FIG. 6 is a table showing interpolated nominal formant frequencies;

DETAILED DESCRIPTION OF THE PREFERRED EMBODIMENTS

Figure 1:
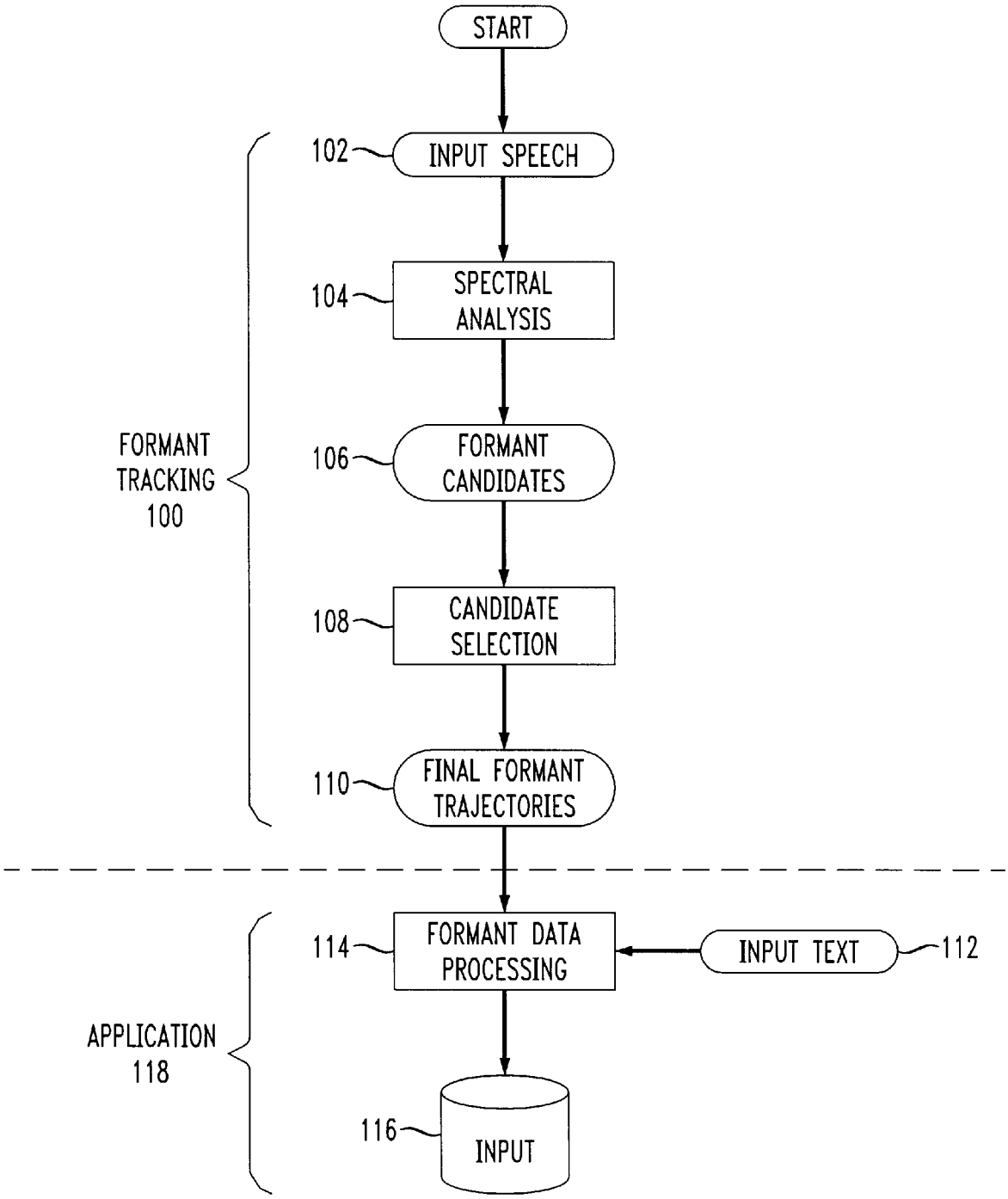
FIG. 1 PRIOR ART
FIG. 1 is a flow diagram illustrating a conventional method of speech signal processing.
Figure 2:
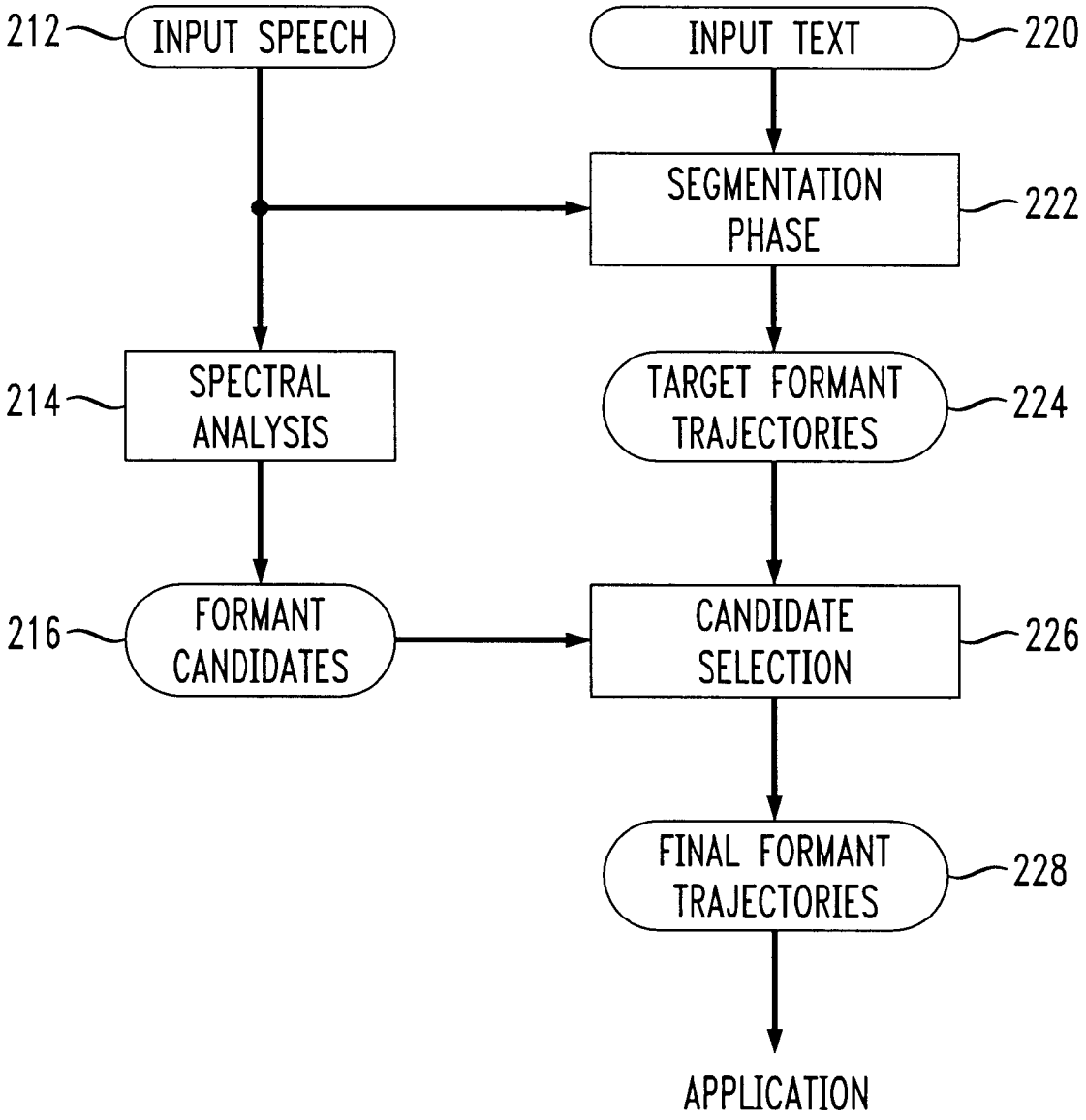
FIG. 2 is a flow diagram illustrating one method of speech signal processing according to the invention.

FIG. 2 is a diagram illustrating preferred form for the general methodology of the invention. Referring to the figure, a spectral analysis is performed on input speech 212 in a plurality of time frames in Step 214. The interval between the frames can vary widely but a typical interval is approximately 5 milliseconds. In a preferred embodiment of the invention, spectral analysis 214 is performed by pre-emphasizing certain portions of the frequency spectrum representing the input speech and then using linear predictive coding (LPC) to extract formant candidates 216 for each frame by solving the roots of a linear prediction polynomial. Input Speech 212 is pre-emphasized such that the effect of glottal excitation and lip radiation to the spectrum is canceled. By doing this, the pre-emphasized speech will contain only the portions from the vocal tract, the shape of which determines the formants of the input speech. Pre-emphasis and LPC processes are well known in the art of speech signal processing. Other techniques for generating formant candidates known to those skilled in the art can be used as well.

In addition to processing speech, the corresponding text is also processed. Input text 220, which corresponds to input speech 212, is converted into a sequence of phonemes which are time aligned with the corresponding segment of input speech 212 (Step 222). Target formant trajectories 224 which best represent the time-aligned phonemes are generated by interpolating nominal formant frequency data for each phoneme across the time frames. Formant candidates 216 are compared with target formant trajectories 224 in candidate selection 226. The formant candidates that are closest to the corresponding target formant trajectories are selected as final formant trajectories 228, which are output for storage or another speech processing application.

The methodology of the invention is described herein and also in "Formant Tracking using Segmental Phonemic Information", a presentation given by the inventors of the invention at Eurospeech '99, Budapest, Hungary on Sep. 9, 1999, the eritirety of which is incorporated by reference herein. U.S. Pat. No. 5,751,907 to Moebius et al., having common assignee and inventorship as the invention, is also incorporated by reference herein.

Figure 3:
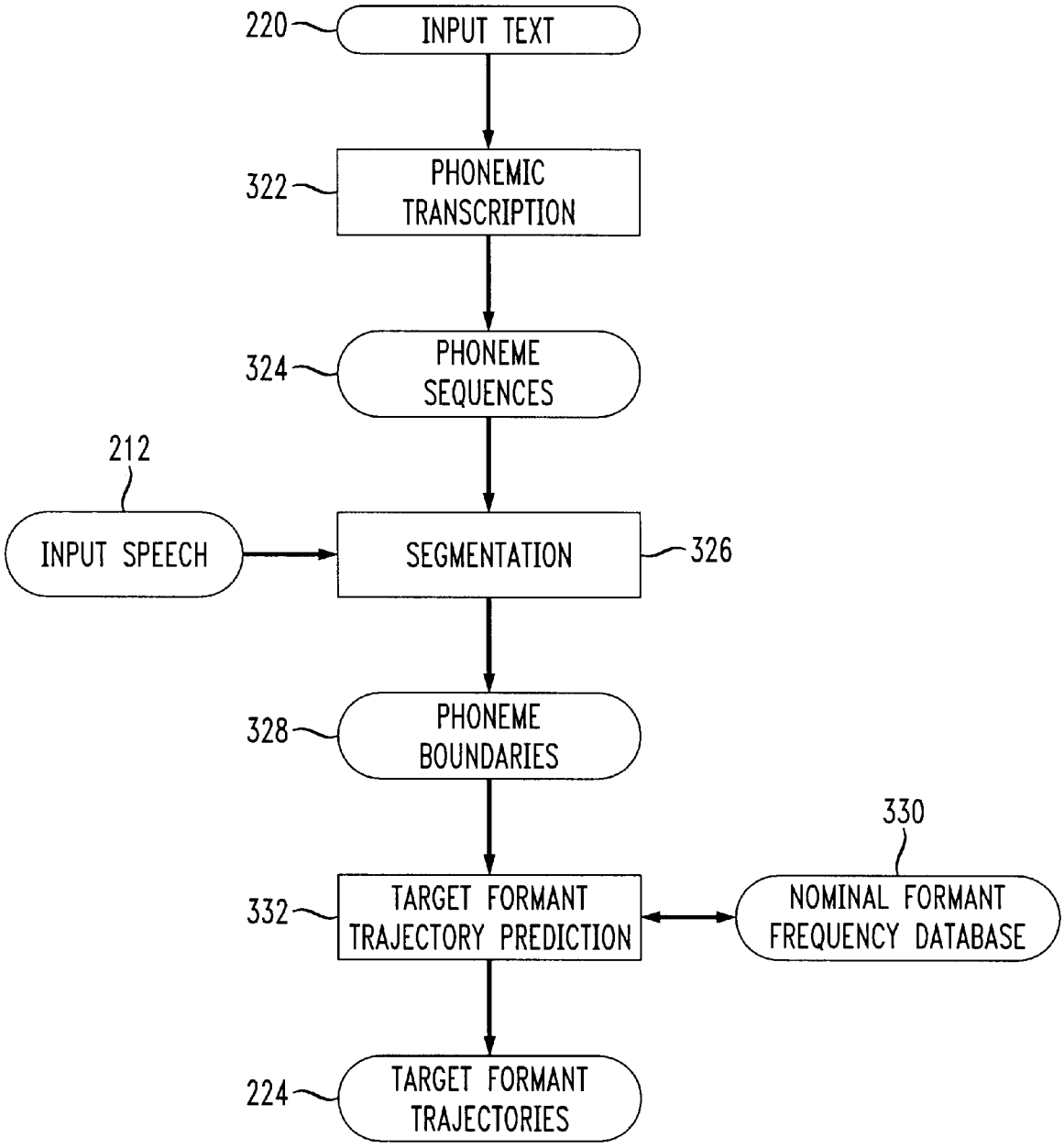
FIG. 3 is a flow diagram illustrating one method of performing the segmentation phase of FIG. 2.

Segmentation phase 222 is described in further detail with reference to FIG. 3. Input text 220 is converted into phoneme sequences 324 in a phonemic transcription step 322 by breaking the input text 220 into phonemes (small units of speech sounds that distinguish one utterance from another). Each phoneme is temporally aligned with a corresponding segment of input speech 212 in segmentation step 326. Based on the temporal alignment, phoneme boundaries 328 are determined for each phoneme in phoneme sequences 324 and output for use in a target formant trajectory prediction step 332.

A typical output table that lists the identity and temporal end points (phoneme boundaries 328) for specific phoneme sequences is shown in FIG. 4. Referring to the figure, line 40 (** * s"E D& s"E * "OtiN g"l) is the phonemic transcription (in ASCII text) of a specific segment of input text, "See the sea oting guy." The columns 42, 44, 46 contain the phonemic transcription, phonemes and corresponding timing endpoints or phoneme boundaries in seconds, respectively. The table data can be generated manually using computer tools or by automatic segmentation techniques. Since the phoneme boundaries of individual phonemes are known, the center points can be easily calculated. Preferably, the center points are substantially the center time between the start and end points. However, the exact value is not critical and can be varied as needed and desired.

Referring back to FIG. 3, using the center points of each phoneme, the phonemes are temporally aligned with the corresponding segments of input speech 212. Nominal formant frequencies are then assigned to the center point of each phoneme in phoneme sequences 324. Nominal formant frequencies that correspond to specific phonemes are known and can be supplied via a nominal formant frequency database 330 which is commonly available in the art.

According to a further aspect of the invention a confidence measure can also be supplied for each phoneme entry in the database. The confidence measure is a credibility measure of.the value of the nominal formant frequencies supplied in the database. For example, if the confidence measure is 1, then the nominal formant frequency is highly credible. An exemplary table listing nominal formant frequencies and a confidence measure for specific phonemes is shown in FIG. 5. Confidence measure (CM) for specific types of phonemes (column 52), and three nominal formant frequencies $F_1$, $F_2$, and $F_3$ (columns 54, 56, and 58, respectively), are correspondingly listed for each phoneme in the "Symbol" column (50). An exemplary phoneme symbol in the Symbol column is /i/, which is the vowel "ea" in the word "beat." In a specific embodiment of the invention, CM is 1.0 for pure voiced sounds, 0.6 for nasal sounds, 0.3 for fricative sounds, and 0 for pure unvoiced sounds.

Referring back to FIG. 3, the nominal formant frequencies of the phonemes (e.g., obtained from the table in FIG. 5) are assigned to the center point of each phoneme in Step 332 (target formant trajectory prediction). The nominal formant frequencies and the confidence measure (CM) are then interpolated from one center point to the next in phoneme sequences 324. Preferably, the interpolation is linear. Based on the nominal formant frequencies assigned to each phoneme, a number of time points are "labeled" to mark the time frames of the input speech in a time vs. frequency association with individual phonemes in phoneme sequences 324, each label being accompanied by its corresponding nominal formant frequencies. Based on the timing information, target formant trajectories 224 are generated by resampling the linearly interpolated trajectories of nominal formant frequencies and confidence measures localized at the center points of the phonemes.

The target formant trajectories 224 are then used to improve the formant candidate selection. FIG. 6 is a table that shows an exemplary output that lists the target phoneme information for individual phonemes in various time frames. Referring to the figure, the timing information for individual phonemes in phoneme sequences 324 is shown in the "time" column (60), the confidence measure in the "CM" column (62), and nominal formant frequencies in the $F_1$, $F_2$, and $F_3$ columns, 64, 66, and 68, respectively.

Figure 7:
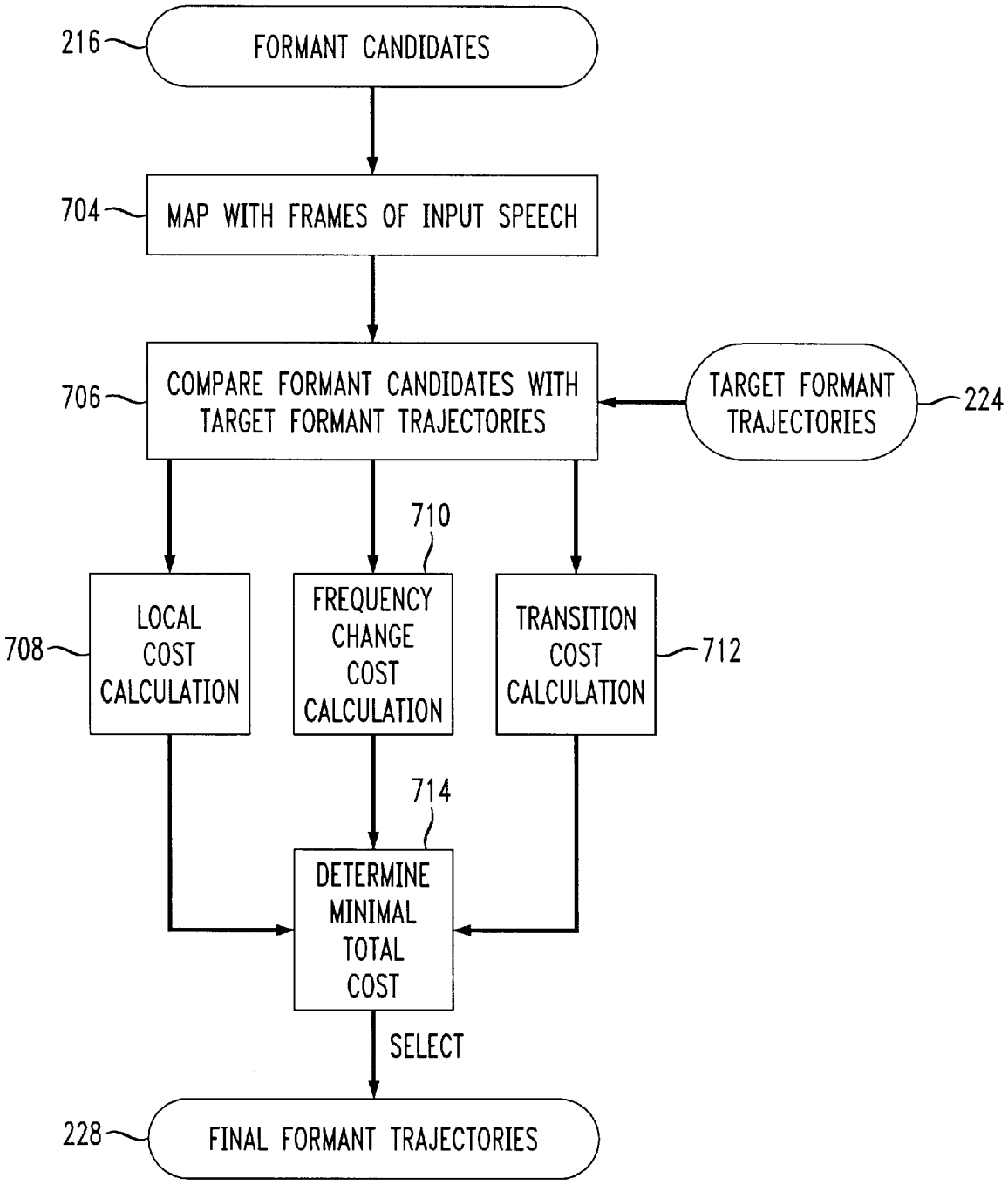
FIG. 7 is a flow diagram illustrating a method of performing formant candidate selection according to the invention.

FIG. 7 is a flow diagram illustrating the formant candidate selection process in further detail. Referring to the figure, target formant trajectories 216 are first mapped to specific time frames of input speech 212 in Step 704. Input speech 212 is analyzed in a plurality of time frames, where formant candidates 216 are obtained for each respective time frame. Target formant trajectories 224 are generated for each time frame by interpolating the nominal formant frequencies between adjacent phonemes of the text data corresponding to input speech 212. Formant candidate, selection is then performed for each time frame of input speech 212 by selecting the formant candidates which are closest to the corresponding target formant trajectories in accordance with the minimum of one or more cost factors.

Numerous combinations of formant candidates 21 6 are possible in selecting the formant candidates for all the time frames of input speech 212. The first step in formant candidate selection is to map formant candidates 216 with time frames of input speech 212, as shown in Step 704. Formant candidate selection is preferably implemented by choosing the best set of N final formant trajectories from n formant candidates over k time frames of input speech 212.

For each frame of input speech 212, there are $L_k$ ways to map or assign formant candidates 216 to final formant trajectories 228. The $L_k$ mappings from n formant candidates to N final formant trajectories are identified as:

$$L_k = \binom{n}{N} = \frac{n!}{(n-N)!N!} \quad \text{(Eq. 1)}$$

where n is the number of formant candidates obtained during spectral analysis, i.e., the number of complex pole pairs obtained by calculating the roots of a linear prediction polynomial (Step 214 of FIG. 2), and N is the number of final formant trajectories of interest.

For each frame of input speech 212, formant candidates 216 are compared with target formant trajectories 224 in Step 706. The formant candidates which are closest to target formant trajectories 224 are selected as final formant trajectories 228. In such an evaluation process, formant candidates 216 are selected based on "costs." A cost is a measure of the closeness, or conversely the deviation, of formant candidates 216 with respect to target formant trajectories 224. The "cost" value assigned to a formant candidate reflects the degree to which the candidate satisfies certain restraints such as continuity between speech frames of the input speech. The higher the cost, the greater the probability that the formant candidate has a larger deviation from the corresponding target formant trajectory.

For example, it is known that certain formant candidates for the vowel "e" are much more plausible than others. In formant candidate selection, a cost is a measure of the closeness, or conversely the deviation, of formant candidates 216 with respect to target formant trajectories 224. In formant candidate selection, certain cost factors, such as a local cost, a frequency change cost, a transition cost, are calculated in Steps 708, 710 and 712, respectively. Based on the cost factors calculated, the candidates with minimal total costs are determined in Step 714.

The costs can be determined in various ways. A preferred method is described below. Final formant trajectories 228 are then selected from formant candidates 216 that are plausible based on the minimal total cost calculation. That is, the formant candidates with the lowest cost are selected as target formant trajectories 228.

Referring to Step 708, the local cost refers to the cost associated with the deviation of formant candidates with respect to the target formant frequencies, which are the formant frequencies of the current time frame sampled from target formant trajectories 224. The local cost also penalizes formant candidates with wide formant bandwidth. The local cost $\lambda_{kl}$, of the $l^{th}$ mapping at the $k^{th}$ frame of input speech 212 is determined based on the formant candidates, $F_{kln}$, and bandwidths, $B_{kln}$, and the deviation from the target formant frequencies for the phoneme, $Fn_n$ (Step 708). The value of the local cost can be represented as:

$$\lambda_{kl} = \sum_{n=1}^{N} \left\{ \beta_n B_{kln} + \upsilon_n \mu_n \frac{|F_{kln} - Fn_n|}{Fn_n} \right\} \quad \text{(Eq. 2)}$$

where $\beta_n$ is an empirical measure that sets the cost of bandwidth broadening for the $n^{th}$ formant candidate, $v_n$ is the confidence measure, and $\mu_n$ indicates the cost of deviations from the target formant frequency of the $n^{th}$ formant candidate.

Referring to Step 710, the frequency change cost refers to the cost in the relative formant frequency change between adjacent time frames of input speech 212. The frequency change cost, $\xi_{kljn}$, between the $l^{th}$ mapping at frame k of input speech 212 and the $j^{th}$ mapping at frame (k−1) input speech 212 for the $n^{th}$ formant candidate is defined as:

$$\xi_{kljn} = \left\{ \frac{F_{kln} - F_{k-1jn}}{F_{kln} + {}_{k-1jn}} \right\}^2 \quad \text{(Eq. 3)}$$

A quadratic cost function provided for the relative formant frequency change between the time frames of input speech 212 is appropriate since formant candidates vary relatively slowly within phonetic segments. The quadratic cost function is provided to penalize any abrupt formant frequency change between formant candidates 216 across time frames of input speech 212. The use of a second (or higher) order term allows tracking legitimate transitions while avoiding large discontinuities.

Referring to Step 712, the transition cost refers to the cost in maintaining constraints on the continuity between adjacent formant candidates. The transition cost is calculated to minimize the sharpness of rise and fall of formant candidates 216 between time frames of input speech 212 so that the formant candidates selected as final formant trajectories 228 present a smooth contour in the synthesized speech. The transition cost, $\delta_{klj}$, is defined as a weighted sum of the frequency change cost of individual formant candidates:

$$\delta_{klj} = \psi_k \sum_{n=1}^{N} \alpha_n \xi_{kljn} \quad \text{(Eq. 4)}$$

where $\alpha_n$ indicates the relative cost of inter-frame frequency changes in the $n^{th}$ formant candidate, and the stationarity measure ($\psi_k$) is a similarity measure between adjacent frames k−1 and k. The stationarity measure, $\psi_k$, is designed to modulate the weight of the formant continuity constraints based on the acoustic/phonetic context of the time frames of input speech 212. For example, formants are often discontinuous across silence-vowel, vowel-consonant, and consonant-vowel boundaries. Continuity constraints across those boundaries are to be avoided. Forced propagation of formants obtained during intervocalic background noise should be avoided.

The stationarity measure ($\psi_k$) can be any kind of similarity measures or inverse of distance measures such as inter-frame spectral distance measures in the LPC or cepstral domain. In a specific embodiment of the invention, the stationarity measure ($\psi_k$) is represented by the relative signal energy (rms) by which the weight of the continuity constraint is reduced near the transient region. The stationarity measure ($\psi_k$) is defined as the relative signal energy (rms) at the current time frame of the input speech:

$$\psi_k = \frac{rms_k}{\max_{(i \in K)} rms_i} \quad \text{(Eq. 5)}$$

with $rms_k$ as the speech energy signal (rms) in the $k^{th}$ time frame of input speech 212.

In a specific embodiment of the invention, the constants $\alpha_n$, $\beta_n$, and $\mu_n$ are independent of n. The values of $\alpha_n$ and $\beta_n$ are determined empirically, while the value of $\mu_n$ is varied to find the optimal weight for the cost of deviation from the nominal formant frequencies.

The minimal total cost is a measure of deviation of formant candidates 216 from target formant trajectories 224. Final formant trajectories 228 are selected by choosing the formant candidates with the lowest minimal total cost. The minimal total cost, C, of choosing formant candidates 216 to target formant trajectories 224 over k time frames of input speech 212, with $L_k$ mappings at each time frame, is defined as:

$$C = \sum_{k=1}^{K} \min_{l \in L_k} D_{kl} \quad \text{(Eq. 6)}$$

Figure 8:
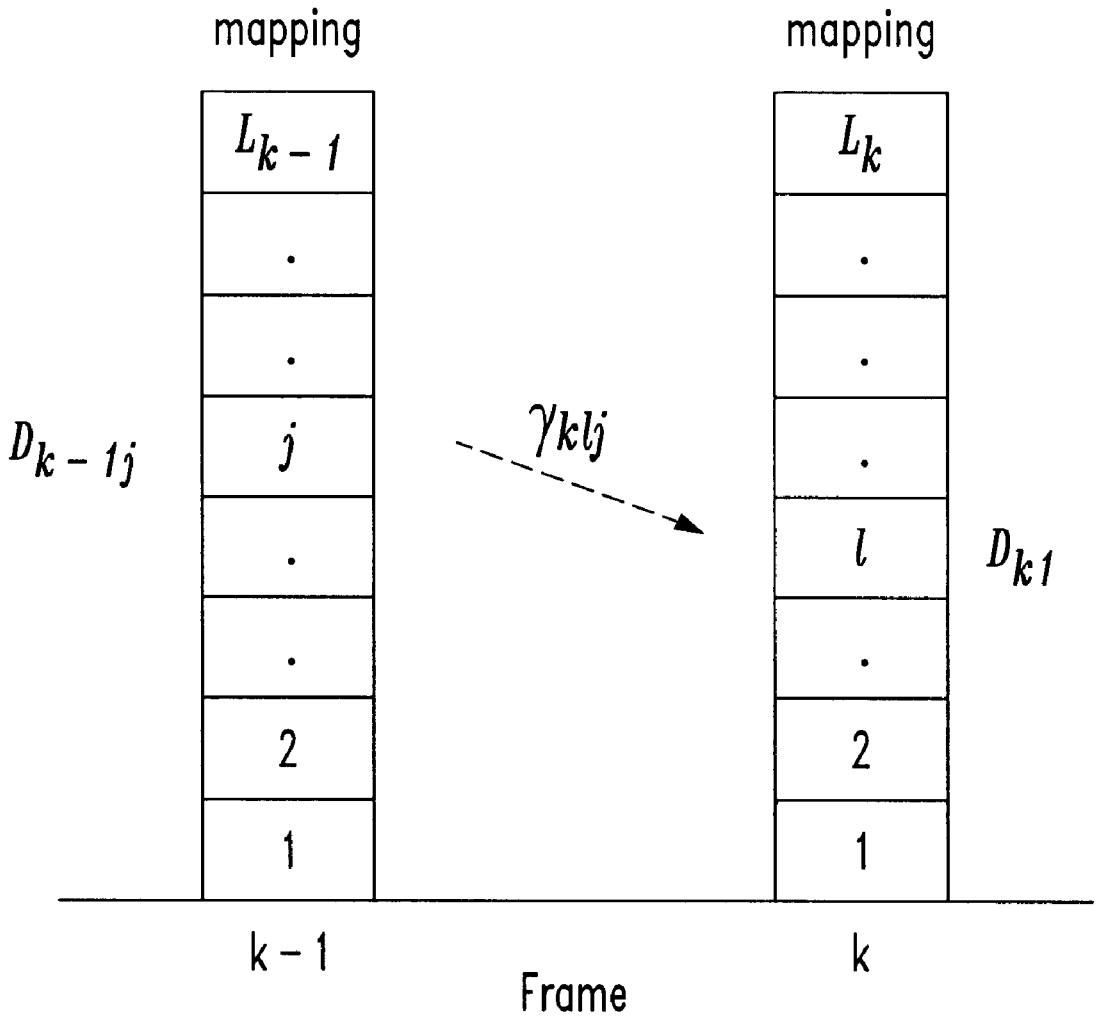
FIG. 8 is a diagram illustrating the mapping of formant candidates and the cost calculations across two adjacent time frames of the input speech according to the invention.

FIG. 8 is a diagram illustrating the mapping of formant candidates and the cost calculations across two adjacent time frames, k−1 and k, of input speech 212. Referring to the figure, there are 1 through $L_{k-1}$ mappings for time frame k−1, and 1 through $L_k$ mappings for time frame k. The mapping cost of the current time frame is a function of the local cost of the previous time frame, the transition cost of the transition between previous and current time frames, and the mapping cost of the previous time frame. The mapping cost, $D_{kl}$, for the $l^{th}$ mapping at the $k^{th}$ time frame in input speech 212 is defined as:

$$D_{kl} = \lambda_{kl} + \min_{j \in L_{k-1}} \gamma_{klj} \quad \text{(Eq. 7)}$$

where $\lambda_{kl}$ is given in Eq. 2, and $\gamma_{klj}$, the connection cost from the $j_{th}$ mapping at time frame k−1 to the $l^{th}$ mapping in time frame k, is defined by the recursion:

$$\gamma_{klj} = \delta_{klj} + D_{(k-1)j} \quad \text{(Eq. 8)}$$

The formant candidates with the lowest calculated cost are then selected as final formant trajectories 228 for input speech 212. Final formant trajectories are maximally continuous while the spectral distance to the nominal formant frequencies at the center point is minimized. As a result, formant tracking is optimized and tracking errors are significantly reduced.

Figure 9A:
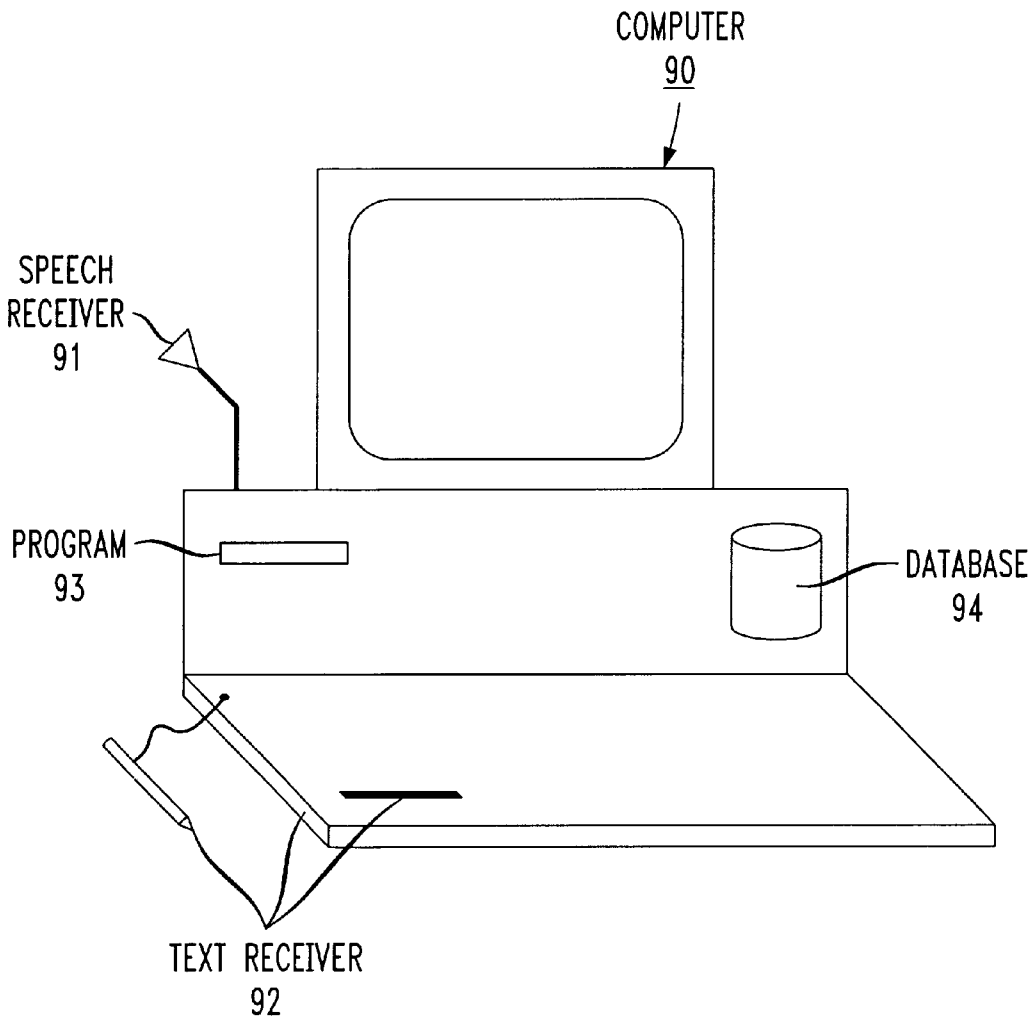
FIGS. 9A and 9B are block diagrams illustrating a computer console and a DSP system, respectively, for implementing the method of the invention.
Figure 9B:
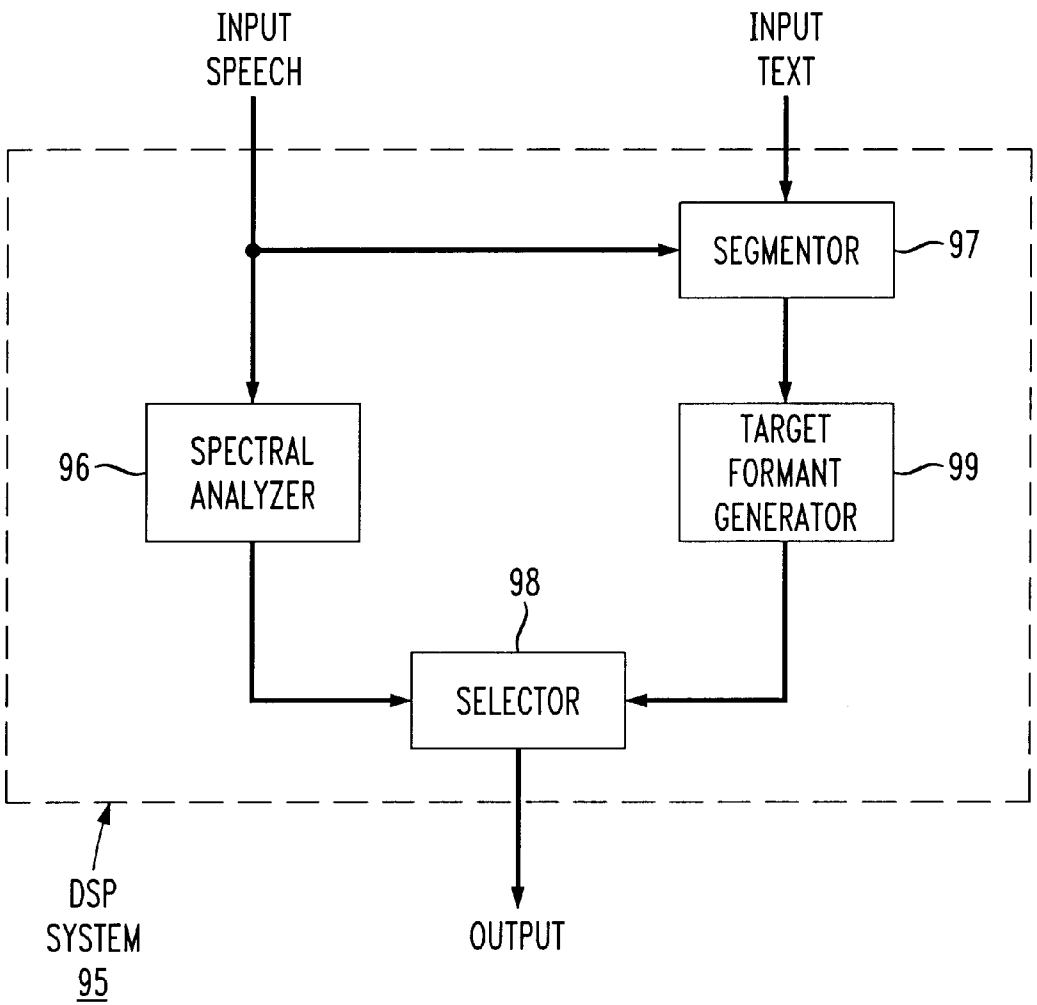

The invention can be implemented in a computer or a digital signal processing (DSP) system. FIGS. 9A and 9B are schematics illustrating a computer and a DSP system, respectively, capable of implementing the invention. Referring to FIG. 9A, computer 90 comprises speech receiver 91, text receiver 92, program 93, and database 94. Speech receiver 91 is capable of receiving input speech, and text receiver 92 is capable of receiving text data corresponding to the input speech. Computer 90 is programmed to implement the method steps of the invention, as described herein, which are performed by program 93 on the input speech received at speech receiver 91 and the corresponding text data received at text receiver 92. Speech receiver 91 can be a variety of audio receivers such as a microphone or an audio detector. Text receiver 92 can be a keyboard, a computer-readable pen, a disk drive that reads text data, or any other device that is capable of reading in text data. After program 93 completes the method steps of the invention, the final formant trajectories generated can be stored in database 94, which can be retrieved for subsequent speech processing applications.

Referring to FIG. 9B, DSP system 95 comprises spectral analyzer 96, segmentor 97, and selector 98. Spectral analyzer 96 receives the input speech and produces as output one or more formant candidates for each of a plurality of time frames. Segmentor 97 receives the input text and produces a sequence of phonemes as output, temporally aligns each phoneme with a corresponding segment of the input speech, and associates nominal formant frequencies with the center point of a phoneme. Target trajectory generator 99 receives the nominal formant frequencies, the confidence measures, and center points as input and generates a target formant trajectory for each time frame of the input speech according to the interpolation of the nominal formant frequencies and the confidence measures. Selector 98 receives the target formant trajectory for each time frame from segmentor 97 and one or more formant candidates from spectral analyzer 96. For each time frame of the input speech, selector 98 identifies a particular formant candidate which is closest to the corresponding target formant trajectory in accordance with one or more cost factors. Selector 98 then outputs the identified formant candidates for storage in a database, or for further processing in subsequent speech processing applications.

Although the invention has been particularly shown and described in detail with reference to the preferred embodiments thereof, the embodiments are not intended to be exhaustive or to limit the invention to the precise forms disclosed herein. It will be understood by those skilled in the art that many modifications in form and detail may be made therein without departing from the spirit and scope of the invention. Similarly, any process steps described herein may be interchangeable with other steps in order to achieve the same result. All of such modifications are intended to be encompassed within the scope of the invention, which is defined by the following claims and their equivalents.

We claim:

1. A method for selecting formant trajectories based on input speech corresponding to text data, the method comprising the steps of:

analyzing the input speech in a plurality of time frames to obtain formant candidates for the respective time frame;

converting the text data into a sequence of phonemes;

segmenting the input speech by putting in temporal boundaries;

aligning the sequence of phonemes with a corresponding segment of the input speech;

assigning nominal formant frequencies to a center point of each phoneme;

generating target formant trajectories for each of the plurality of time frames by interpolating the nominal formant frequencies between adjacent phonemes;

for each time frame, selecting at least one formant candidate which is closest to the corresponding target formant trajectories in accordance with the minimum of at least one cost factor; and outputting the selected formant candidates.

2. The method of claim 1, wherein the at least one cost factor includes a local cost which is a measure of a deviation of the formant candidates from the corresponding target formant trajectory.

3. The method of claim 1, wherein the at least one cost factor comprises at least one of a minimal total cost, a frequency change cost, and a transition cost.

4. The method of claim 3, the at least one cost factor further comprising a mapping cost, wherein the mapping cost of a time frame of the input speech is a function of the local cost of a previous time frame, the transition cost of a transition between the previous time frame and the time frame, and the mapping cost of the previous time frame.

5. The method of claim 1, the at least one cost factor comprising a transition cost, wherein the transition cost is a function of a stationarity measure, the stationarity measure being a function of a relative signal energy at a time frame of the input speech.

6. The method of claim 1, further comprising the step of assigning a confidence measure based on the voice types of the phonemes.

7. The method of claim 6, wherein the voice types of the phonemes consist the group of pure voice, nasal sounds, fricative sounds, and pure unvoiced sounds.

8. The method of claim 6, further comprising the step of determining a particular confidence measure for each time frame by interpolating the confidence measure between adjacent phonemes.

9. The method of claim 1, wherein the formant candidates are obtained using linear predictive coding.

10. The method of claim 1, further comprising the step of pre-emphasizing portions of the input speech prior to the analyzing step.

11. A system for selecting formant trajectories based on speech corresponding to text data, the system comprising:

a spectral analyzer receiving the speech as input and producing as output one or more formant candidates for each of a plurality of time frames;

a segmentor receiving the text data as input and producing a sequence of phonemes as output, each phoneme being temporally aligned with a corresponding segment of the input speech, and having nominal formant frequencies associated with a center point;

a target formant generator receiving the nominal formant frequencies and center points as input and generating a target formant trajectory for each time frame according to an interpolation of the nominal formant frequencies; and a selector receiving for each time frame the target formant trajectory and the at least one formant candidate and identifying a particular formant candidate which is closest to the corresponding target formant trajectory in accordance with at least one cost factor.

12. The system of claim 11, wherein the spectral analyzer, the segmentor, the target formant generator and the selector are implemented on one of a general purpose computer and a digital signal processor.

13. The system of claim 11, wherein the at least one cost factor includes a local cost which is a measure of a deviation of the formant candidates from the corresponding target formant trajectory.

14. The system of claim 11, wherein the at least one cost factor comprises at least one of a minimal total cost, a frequency change cost, and a transition cost.

15. The system of claim 11, wherein the segmentor assigns a confidence measure to a center point of each phoneme.

16. The system of claim 15, wherein the confidence measure is dependent on voice types of the phonemes.

17. The system of claim 11, wherein the selector identifies the formant candidates by linear predictive coding.

18. A method of selecting formant trajectories based on input speech and corresponding to text data, the method comprising the steps of:

segmenting the text data comprising the substeps of;

converting text data into a phonemic sequence;

aligning temporally the input speech into a plurality of time frames with the phonemic sequence to form individual phonemes divided by phoneme boundaries;

calculating center points between the phoneme boundaries; and assigning nominal formant frequencies to the center points of each phoneme in the phoneme sequence;

interpolating the nominal formant frequencies over the plurality of time frames to generate a plurality of target formant trajectories;

calculating a plurality of formant candidates for each time frame from the input speech by applying Linear predictive coding techniques; and selecting a particular formant candidate from the plurality of formant candidates for each time frame which is closest to the corresponding target formant trajectories in accordance with the minimum of at least one cost factor.

19. The method of claim 18, wherein the assigning nominal formant frequencies step the nominal formant frequency is associated with a confidence measure indicating the credibility of the nominal formant frequency, wherein the interpolating step further includes interpolating the confidence measure over the plurality of time frames.

* * * * *